US006613994B2

(12) United States Patent
Bauer et al.

(10) Patent No.: US 6,613,994 B2
(45) Date of Patent: Sep. 2, 2003

(54) MICROSWITCH MODULE

(75) Inventors: Gunter Bauer, Sulzbach-Rosenberg (DE); Wolfgang Schrufer, Pottenstein (DE)

(73) Assignee: Cherry GmbH, Auerbach/Opf. (DE)

( * ) Notice: Subject to any disclaimer, the term of this patent is extended or adjusted under 35 U.S.C. 154(b) by 19 days.

(21) Appl. No.: 09/788,677

(22) Filed: Feb. 21, 2001

(65) Prior Publication Data

US 2001/0042679 A1 Nov. 22, 2001

(30) Foreign Application Priority Data

Feb. 21, 2000 (EP) ..... 00103328

(51) Int. Cl.[7] ..... H01H 1/00
(52) U.S. Cl. ..... 200/273; 200/512
(58) Field of Search ..... 200/273, 5 A, 200/512, 517, 345, 329, 341, 302.1–302.3

(56) References Cited

U.S. PATENT DOCUMENTS

| | | | | |
|---|---|---|---|---|
| 4,018,999 A | | 4/1977 | Robinson et al. | |
| 4,794,215 A | * | 12/1988 | Sawada et al. | 200/512 |
| 4,843,197 A | | 6/1989 | Kojima et al. | |
| 4,913,285 A | * | 4/1990 | Tsutsumi et al. | 200/306 |
| 4,987,278 A | * | 1/1991 | Tsutsumi | 200/294 |
| 5,828,016 A | | 10/1998 | Grannan et al. | |
| 5,924,555 A | | 7/1999 | Sadamori et al. | |
| 5,986,228 A | | 11/1999 | Okamoto et al. | |
| 6,388,218 B1 | * | 5/2002 | Ando et al. | 200/512 |

FOREIGN PATENT DOCUMENTS

| | | | |
|---|---|---|---|
| DE | 2044003 | * 10/1980 | 200/330 |
| DE | 4335246 | 4/1994 | |
| EP | 0483898 | 5/1992 | |
| EP | 0616345 | 9/1994 | |
| EP | 0845795 | 6/1998 | |
| GB | 2261769 | 5/1993 | |

* cited by examiner

*Primary Examiner*—Elvin Enad
*Assistant Examiner*—Lisa N Klaus
(74) *Attorney, Agent, or Firm*—Miles & Stockbridge P.C.; Edward J. Kondracki; John C. Kerins

(57) ABSTRACT

A method of making a microswitch module which comprises the steps of: charging a molten resin onto a loading surface of a microswitch; disposing an actuator element onto the molten resin charged onto the loading surface of the microswitch; and ensuring that the actuator element remains fixed while at least part of the the molten resin hardens into a layer of resilient material thereby providing a microswitch module wherein the actuator element is adapted to transmit a mechanical switching force to the loading surface of the microswitch through the layer of resilient material for actuating the micro switch. Additionally, a micro switch module comprises a micro switch; a layer of resilient material disposed on a loading surface of the microswitch; and an actuator element disposed on the layer of resilient material for transmitting a mechanical switching force therethrough to the loading surface of the microswitch for actuating the microswitch.

10 Claims, 8 Drawing Sheets

MICROSWITCH MODULE

FIELD OF THE INVENTION

The present invention relates to switch assemblies incorporating microswitches, and to methods of making same.

DESCRIPTION OF RELATED ART

Various embodiments for microswitches and switches incorporating resilient membranes have already been disclosed in the prior art.

In particular, DE 196 53 322 A1, depicts, as seen in FIG. 1 of the document, a microswitch defining a contact space 6 formed between a glass substrate 2 and a silicon membrane 4. Electric contacts 7, 8 and 9 are provided on opposite inner sides 2*a* and 3*c* of the substrate 2 and the silicon membrane, and contact conductors 10 and 11 are led out of the contact space. A single contact is provided on the inside of the silicon membrane as a contact bridge 9. Additionally, two separate fixed contacts 7 and 8 are connected with the contact conductors on the inside of the substrate as contact partners for the contact bridge, the contact space being preferably hermetically sealed.

It is generally known in the art that the glass disc and silicon membrane may be permanently fused to each other by anodic bonding and form a completely sealed switch area in which two gold plated contacts are located. The silicon disc may be thinned to a few 10 micrometers over a cavity and serves as the surface for receiving the switching pressure. In the event of external loading, the silicon membrane deforms to allow both contacts to touch, thereby closing the circuit.

U.S. Pat. No. 5,399,821 pertains to a push-button keytop switch. The switch is formed by deforming a flexible resin film such that it bulges upwardly to form a curved portion, and thereafter filling the curved portion with a molding resin. The molding resin is allowed to harden to form a keytop body. The keytop is manufactured by clamping a resin film between upper and lower molds, charging a resin from a pin gate into a cavity provided in the lower mold, thereby deforming and urging the resin film upward by pressure and heat produced by the resin and causing the resin film to adhere to the inner surface of the upper mold. The cavities of the upper and lower molds are filled with the resin, and the molds are separated after the resin hardens.

DE 34 47 085 C2 discloses a push-button switch with an elastic membrane made of rubber-like elastic material such as from elastic rubber, synthetic rubber, or plastic material as the actuating element. The switch exhibits reliable closing of the contacts with a low intrinsic resistance. As seen on FIGS. 1*a* and 1*b*, the membrane has an operating ring 21 acting on the contact link 14 for closing the contact, ring 21 being plastically deformable.

DE 43 35 246 A1 discloses a push button switch and manufacturing process that has a moving contact at push-button 14 and fixed contacts 12. Push-button 14 incorporates a flexible membrane portion at sides thereof which allow a depression of 14 for closing the circuit through touching of the moving and fixed contacts.

Microswitches as disclosed above have the advantage of providing a space saving alternative to regular switches, thereby accommodating the corresponding reduction in size of electronic circuits they are meant to complement. Moreover, microswitches typically provide exact and constant switching points, low contact erosion, constant resistance, and mechanical stability. In addition, switches incorporating mechanically compliant or resilient membranes such as those made of silicon advantageously allow the repeated application of actuation pressures without resulting in fatigue. At the same time, actuation membranes can be provided so as to allow the microswitch and/or switch to exhibit desirable moisture and dust proof properties, further defining a hermetic encapsulation with the possibility of maintaining predetermined microclimates therein. The use of microswitches incorporating resilient membranes can thereby result in an altogether more reliable and cost-effective product for machines, equipment controls, keyboards and other such applications.

While microswitch and membrane switch structures are known, mounting techniques for mounting microswitches in assemblies for further integration into various switching processes have not been fully explored.

BRIEF SUMMARY OF THE INVENTION

An object of the invention is to provide a method for mounting microswitches of the type initially cited which preserves the advantages associated with the microswitch while permitting the microswitch to be integrated in further switching processes in a reliable, cost effective, space-saving manner. Another object of the invention is to provide a microswitch module resulting from the practice of the above method.

The above objects of the invention, and other objects to become apparent as the description progresses, is achieved by providing a method of making a microswitch module comprising the steps of: charging a resin onto a loading surface of a microswitch; disposing an actuator element onto the resin charged onto the loading surface of the microswitch; and ensuring that the actuator element remains fixed while at least part of the resin hardens into a layer of resilient material thereby providing a microswitch module wherein the actuator element is adapted to transmit a mechanical switching force to the loading surface of the microswitch through the layer of resilient material for actuating the microswitch. Advantageously, the above method may include the steps of providing a microswitch housing and disposing the microswitch in a cavity defined by the microswitch housing.

According to one embodiment, the step of disposing the microswitch includes the step of bonding the microswitch to a cavity surface of the cavity defined by the microswitch housing, where the bonding step comprises the steps of charging a liquid adhesive onto the cavity surface; disposing the microswitch onto the liquid adhesive on the cavity surface; and allowing the liquid adhesive to harden.

Additionally, the step of ensuring may further include the step of holding the actuator element in a fixed position onto the dosed amount resin while the resin is hardening, and/or of ascertaining a provision of a pre-determined thickness of the layer of resilient material after hardening of the resin. In the latter case, the actuator element may be pushed onto the resin charged onto the loading surface of the microswitch such that the resin partially migrates to lateral regions of the actuator element.

According to one advantageous embodiment, the step of ensuring further includes the step of holding the actuator element in a fixed position onto the resin charged onto the loading surface of the microswitch such that a top surface of the actuator element is in registration with a top surface of the microswitch housing.

In addition to holding the actuator element in a fixed position with regard to the microswitch housing, the resin fulfills the function of compensating for production tolerances of the actuator element, the microswitch and the microswitch housing. For example, the provision of a top surface of the actuator element being in registration with a top surface of the microswitch housing will for each microswitch module, depending on the specific tolerances of the actuator element, the microswitch and the microswitch housing, result in a different spacing between a bottom surface of the actuator element and a top surface of the microswitch. This variance may be compensated by the thickness of the layer of resin that is formed between the two surfaces when the resin hardens.

The objects of the invention are further achieved through the provision of a microswitch module comprising a microswitch; a layer of resilient material disposed on a loading surface of the microswitch; and an actuator element disposed on the layer of resilient material for transmitting a mechanical switching force therethrough to the loading surface of the microswitch for actuating the microswitch. The module may further comprise a microswitch housing defining a cavity therein, the microswitch being disposed in the cavity of the microswitch housing. The microswitch may further be bonded to a cavity surface of the cavity of the microswitch housing.

In one advantageous embodiment, the actuator element is in registration with a top surface of the microswitch housing.

The invention further includes within its scope the provision of a module housing for receiving therein a switching module. The module may be according to one of the above embodiments. The module housing comprises an outer shell defining a module housing cavity.

Additionally, the invention pertains to a combination comprising the module according to one of the above embodiments and further the module housing which houses the module therein.

The invention further pertains to a switching system that includes a module disposed in a module housing, and further comprises a loading spring secured to the module housing. The module and module housing may be according to one of the embodiments described above. According to one embodiment of the switching system, the loading spring may comprise either a bent resilient sheet having a loading portion thereon or a telescoping spring-biased actuator.

Additionally, the invention pertains to a combination comprising the switching system according to one of the embodiments described above, and further including an actuating mechanism disposed adjacent the switching system for applying a mechanical load to the loading spring thereof for actuating the microswitch of the module. According to one embodiment, the actuating mechanism comprises one of a rotatable cam, a hinged lever and a cover that is one of translationally and rotationally movable by a predetermined distance.

The invention further comprises within its scope a combination comprising the module and the module housing according to one of the embodiments described above and further including an actuating mechanism disposed adjacent the module for applying a mechanical load thereto for actuating the microswitch. Advantageously, the actuating mechanism comprises a rotatable disc housing a spring-biased ball therein.

The invention is set forth in greater detail below with reference to the exemplary embodiments on the basis of the drawings.

BRIEF DESCRIPTION OF THE SEVERAL VIEWS OF THE DRAWINGS

In the appended drawings, where like reference numerals correspond to like features:

FIG. 1, including

DETAILED DESCRIPTION OF THE INVENTION

Figure 1A:
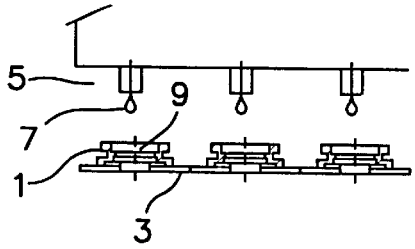
FIGS. 1*a*–1*e*, is a schematic, side-elevational depiction of process steps in a mounting method incorporating the method of the present invention.

FIG. 1 shows a mounting method which incorporates the steps of the method of making a microswitch module according to the invention. As seen in the exemplary embodiment of FIG. 1, a method of making according to the invention involves the provision of a microswitch housing 1 made of a material such as polybutylene terephthalate (PBT), which is preferably of injection grade to allow the injection molding of housing 1 onto a stamped conductive strip 3, such as one made of copper or bronze. See FIG. 3. As seen in FIG. 1*a*, the strip may be placed below a set of pin gates 5 which are adapted to charge a dosed amount of liquid adhesive 7 therefrom. The liquid adhesive is dispensed onto a cavity 9 of each housing 1 as seen more clearly in FIG. 1*b*, where it awaits the introduction of a microswitch 11 thereon in the form of an adhesive drop 13. As further seen in FIG. 1*b*, each microswitch is held above a corresponding housing in registration therewith by way of a suction carrier 15. Thereafter, the suction carriers are brought into the region of cavity 9 for disposing the respective microswitches onto corresponding adhesive drops. Each microswitch 11 is then electrically bonded by means of the electrical connections 17 to the underlying lead frame. The electric connection of the microswitch to the underlying lead frame may also be achieved by wire bonding or by use of an electrically conductive adhesive. Advantageously, each microswitch may be pressed onto the top surface of a corresponding cavity 9 so as to firmly bond it to connections 17 while partially displacing adhesive drop 13 to lateral regions thereof, the adhesive thereby at least partially filling lateral gaps 19 (see FIG. 2) existing between the microswitch and the lateral walls of cavity. As would be recognized by one skilled in the art, the dosing of liquid adhesive 7 may therefore be determined accordingly.

Figure 1B:
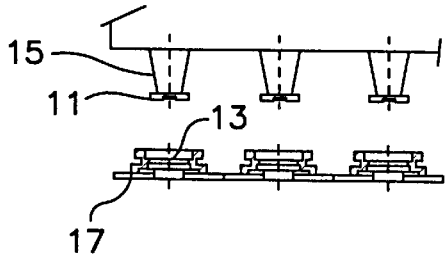
Figure 1C:
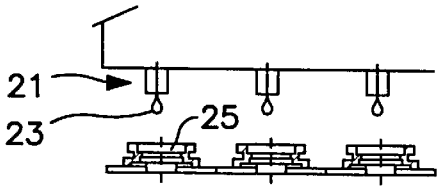
Figure 1D:
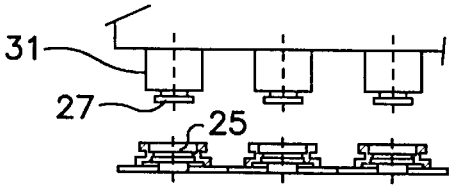
Figure 1E:
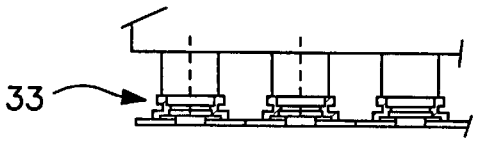
Figure 2:
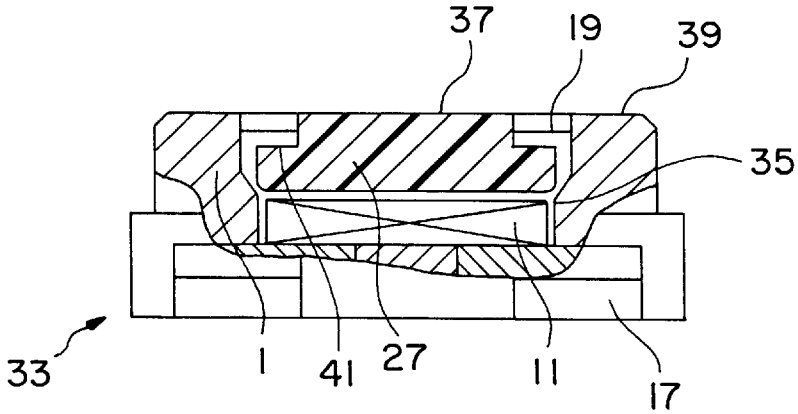
FIG. 2 is a schematic, partially sectional, side elevational view of an exemplary embodiment of a microswitch module resulting from the practice of the method depicted in FIG. 1.
Figure 3:
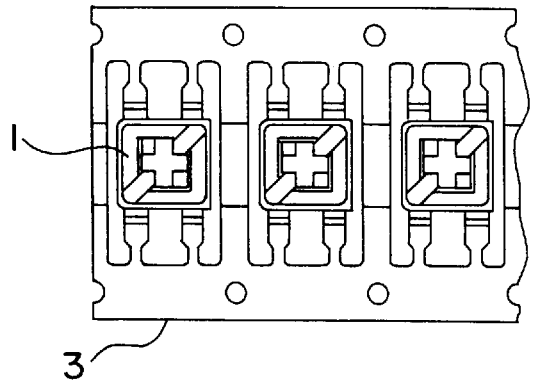
FIG. 3 is a schematic, top plan view of microswitch housings disposed in series on a carrier strip for use in the method shown in FIG. 1.

After the adhesive has hardened, as seen in FIG. 1*c*, the set of partially assembled microswitch modules are brought into registration with a corresponding set of pin gates 21 which then deliver a dosed amount of a resin 23 onto a loading surface 25 of each microswitch. Once on this loading surface, the resin awaits the introduction of an actuator element 27 thereon in the form of a resin drop 29. As further seen in FIG. 1*c*, each actuator element is held above a corresponding resin drop 29 in registration therewith by way of a suction carrier 31 similar to suction carriers 15 for the microswitches as depicted in FIG. 1*b*. Thereafter, as seen in FIG. 1*d*, the suction carriers are brought into the region of resin drops 29 for disposing the respective actuator elements thereon, each actuator element thereby displacing the resin of the resin drop such that it only partially migrates to lateral regions as shown in FIGS. 1*d* and 2. During the step of FIG. 1*e*, it is important to ensure that the actuator element remains fixed while the resin hardens into a layer of resilient material so as to maintain a predetermined module geometry with respect to the relative disposition of the actuator element and its corresponding microswitch. In the module embodiment of the invention shown in the instant figures, it is further important that the actuator element be held fixed during the hardening of the resin such that, in the resulting module as seen in FIG. 2, no spatial offset exists between the top surface of the actuator element and the corresponding top surface of the microswitch housing. The above step is for ascertaining that loading pressures onto the module from actuation mechanisms can always be reliably adjusted with the assumption that the top surfaces of the actuator element and the microswitch housing are in registration. Advantageously, the resin comes into adhering contact with the microswitch, actuator element and housing cavity, thereby providing a reliably united microswitch module.

As seen in FIG. 2, the microswitch module 33 resulting from the method of the invention set forth with respect to FIG.1 comprises a microswitch housing 1 which includes a microswitch 11 therein in electrical contact with connections 17. The microswitch includes a layer 35 of resilient material thereon resulting from a hardening of resin 23. Above the layer of resilient material is disposed an actuator element 27, which has been set such that its top surface 37 is in registration with the top surface 39 of the microswitch housing. In the embodiment of FIG. 2, the hardened resin 41 also fills lateral and certain top regions of actuator element 27, and thus firmly secures in place in the module 33. As can be appreciated from FIG. 2, the module according to the invention allows the application of a mechanical loading force to the microswitch 11 through the intermediary of the actuator element 27 and layer of resilient material 35, which advantageously buffers a loading force or mechanical switching force applied onto the actuator element. The thickness of layer 35, as well as the material for the resin (which would have a bearing on its resilience), can be selected depending on the desired amount of buffering in each particular module.

The microswitch module as shown in FIG. 2 provides a reliable cost-effective switching system which can be easily integrated with actuation mechanisms for implementation in machines, equipment controls, keyboards and other such applications, while ensuring that the advantageous characteristics of the microswitch incorporated therein, including mechanical and electrical stability, space economy, exact and constant switching point and imperviousness to environmental factors such as dust and moisture are preserved. It is noted that the indications of dimensions on the appended figures are in millimeters. These indications provide mere suggestions for the sizing of the module and associated componentry, and are in no way meant to limit the scope of the invention.

Figure 4:
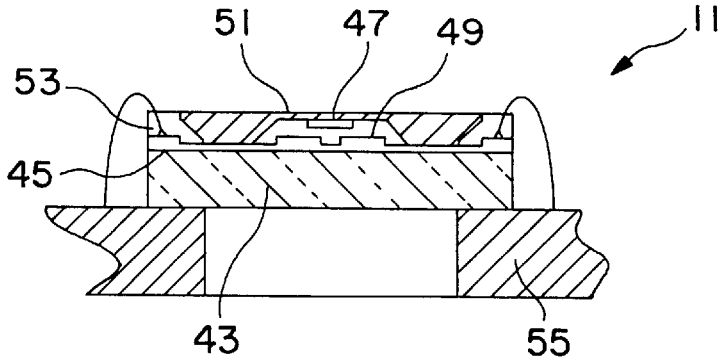
FIG. 4 PRIOR ART
FIG. 4 is a schematic, cross-sectional, side elevational view of a typical microswitch according to the prior art.

FIG. 4 is a schematic view of a typical microswitch 11 which may be integrated into the module of FIG. 2. As already described with respect to DE 196 53 322 A1 above, a microswitch includes a carrier material 43, such as glass, upon which is disposed a fixed connection electrode 45. When the microswitch is open, as shown in FIG. 4, electrode 45 is separated from a movable connection electrode or metal coating 47 by way of a cavity 49 defined along with a switching membrane 51 preferably made of silicon. Wire bondings 53 connect fixed electrode 45 to a metal leadframe 55.

Figure 5A:
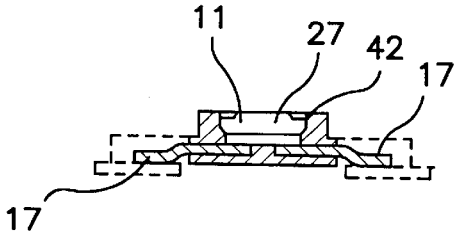
FIGS. 5*a*, 5*b* and 5*c* are schematic views of a further exemplary embodiment of a microswitch module according to the invention depicting a side elevational cross sectional view, a side elevational view, and a top plan view, respectively.
Figure 5B:
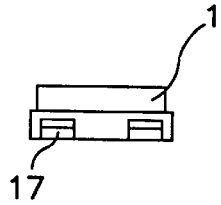
Figure 5C:
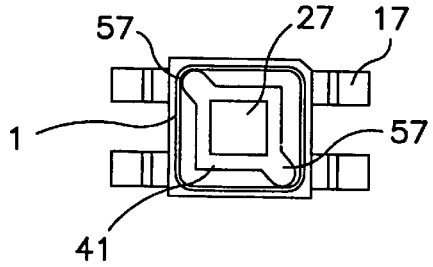

FIGS. 5*a*, 5*b* and 5*c* show a further embodiment of a microswitch module according to the invention. The difference with FIG. 2 is that here, the electrical connections 17 point in a lateral direction with respect to the microswitch. Reference is also made to FIG. 5*c*, which shows a top plan view of an embodiment of the module according to the invention. Here, it can easily be seen that the area about the actuator element filled by the hardened resin follows the outline of the top surface of the actuator element while at the same time presenting diagonally extending channels 57 at two comers thereof.

An important feature of microswitch modules is their capacity to be integrated into further switching applications. For such integrations, however, various basic conditions have to be fulfilled. Since the mechanical loading capacity of a microswitch is relatively low, it is necessary to limit actuation forces thereon. A way to achieve the above is through the use of loading springs and of supplemental actuation mechanisms (as opposed to finger actuation) the mechanical loading paths of which are controllable, but which allow sufficiently long actuation paths. The following structures and mechanisms adapted to be used in conjunction with the microswitch module according to the invention are designed to take the above concerns into consideration.

Figure 6A:
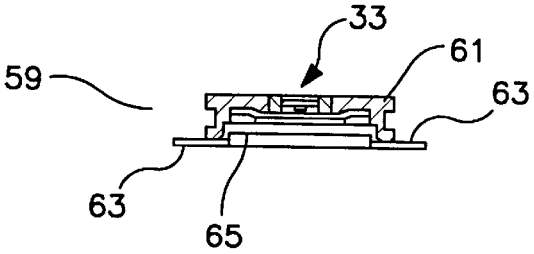
FIGS. 6*a*, 6*b* and 6*c* are schematic views of an embodiment of a module housing for receiving a microswitch module according to the invention depicting a side-elevational cross sectional view, a top plan view, and a bottom plan view, respectively.
Figure 6B:
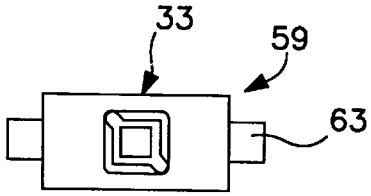
Figure 6C:
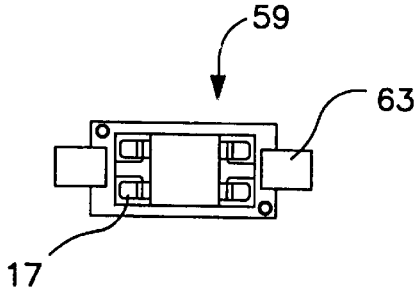
Figure 7:
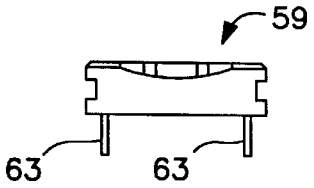
FIG. 7 is a schematic, partially sectional side elevational view of another embodiment of a module housing according to the invention.
Figure 8A:
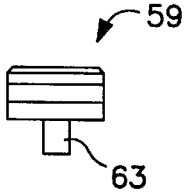
FIGS. 8*a*, 8*b*, 8*c* and 8*d* are schematic, side elevational views of respective further embodiments of a module housing according to the invention.
Figure 8B:
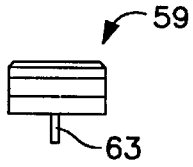
Figure 8C:
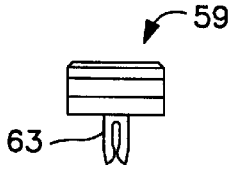
Figure 8D:
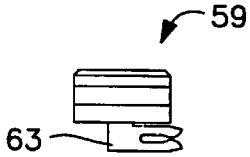

FIGS. 6*a*, 6*b* and 6*c* show an embodiment of a module housing 59 incorporating a microswitch module 33 according to the invention. The module housing is designed to receive the microswitch module therein, as shown in particular in FIG. 6*a*, and comprises an outer shell 61 and electrical contacts 63 disposed adjacent thereto, and, in addition, an inner portion 65 for structurally securing the module in the housing. The housing components, except for contacts 63, may be made of an electrically non-conductive material, such as, for example, a thermoplastic material, and may advantageously be injection molded to integrate the module therein. While the contacts emerging from module housing 59 in FIGS. 6*a* to 6*c* face laterally outward, those in FIG. 7 are directed in a downward direction. In addition, FIGS. 8*a* to 8*d* depict various embodiments of module housings where the contacts are of various thicknesses and/or face in various directions for ease of integration into specific applications.

Figure 9:
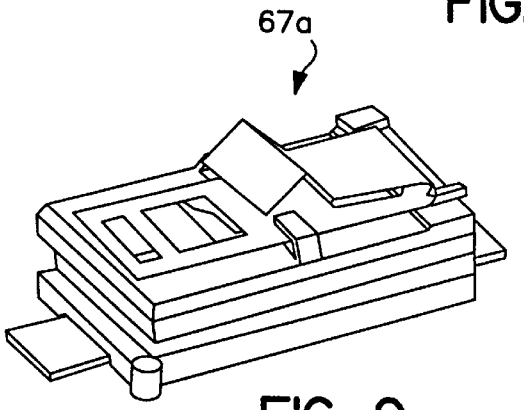
FIG. 9 is a perspective view of a first embodiment of a switching system incorporating the module housing and microswitch module according to the invention.
Figure 10:
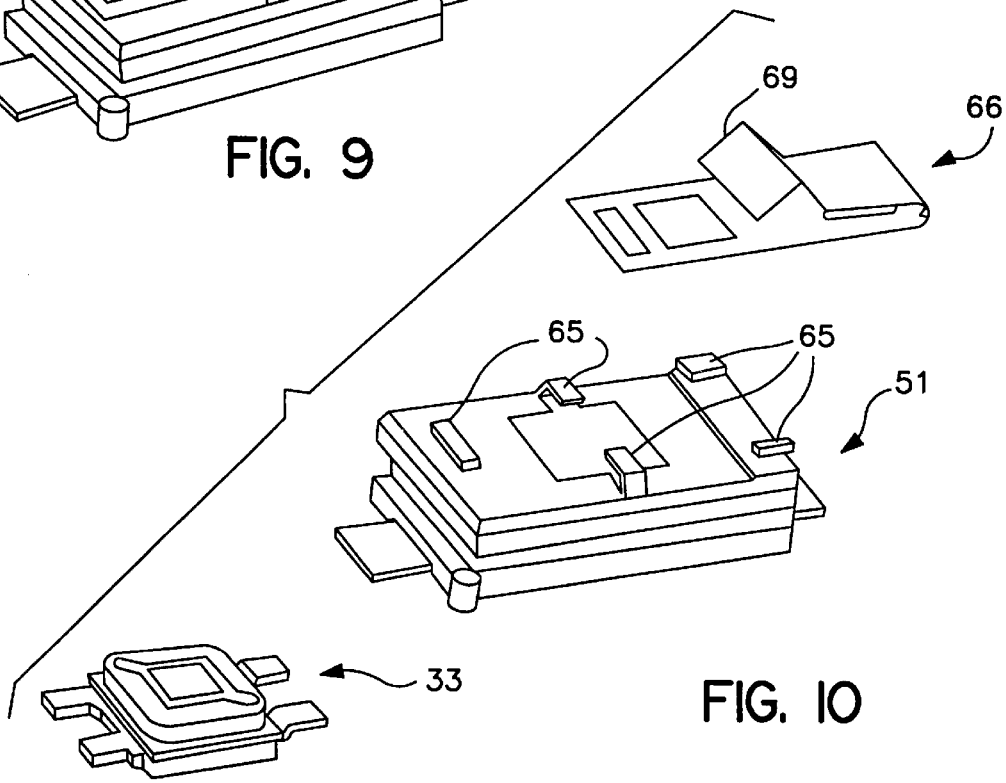
FIG. 10 is an exploded perspective view of the switching system of FIG. 9.

A slight variation of the module housing of FIGS. 6*a*, 6*b* and 6*c* is shown in FIGS. 9 and 10. Here, the housing includes projections 65 thereon for fitting a loading spring 66 onto the module housing, as seen in assembled form in the form of a switching system 67*a* in FIG. 9. The embodiment of the loading spring shown includes a bent resilient sheet having an inverted v-shaped section at the loading portion 69 thereof, the mode of operation of which will be described in further detail below in relation to various associated actuation mechanisms.

Figure 11A:
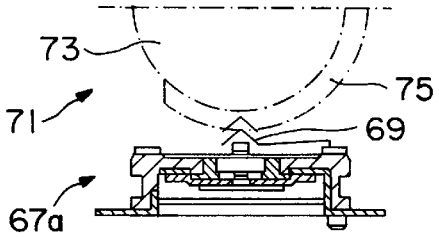
FIGS. 11*a* and 11*b* show a schematic, partially sectional, side elevational view of a first embodiment of an actuation mechanism used in conjunction with the switching system of FIG. 9.
Figure 11B:
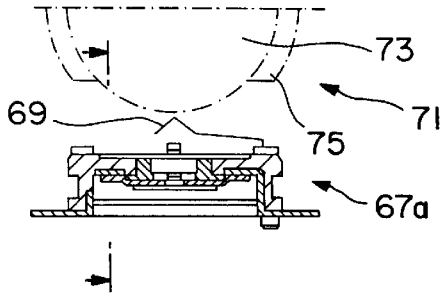

As seen in FIGS. 11*a* and 11*b*, which depict the microswitch module in loaded and unloaded mode, respectively, the switching system of FIG. 9 may be used in conjunction with an actuation mechanism 71 including a rotatable cam 73 featuring projection 75 thereon. Rotation of cam 73 causes projection 75 to apply a downward force on the v-shaped loading portion 69 of loading spring 66, thereby placing the underside of the spring (that is, the surface directly adjacent the microswitch module) under tensile stress. The tension placed on the underside of the spring in turn causes the spring to buckle outward toward the module and to therefore apply an activation pressure thereon, resulting in the same closing the circuit associated therewith. The mechanical loading path (that is, the distance by which the loading portion 69 biases the loading spring in order to load the microswitch module) of the rotatable cam is advantageously controlled by virtue of the limited thickness of projection 75 thereon, while the actuation path for the actuation mechanism is relatively large because the cam may be angularly displaced by an amount corresponding to an angle occupied by projection 75 thereon without effecting a corresponding displacement of loading portion 69.

Figure 12A:
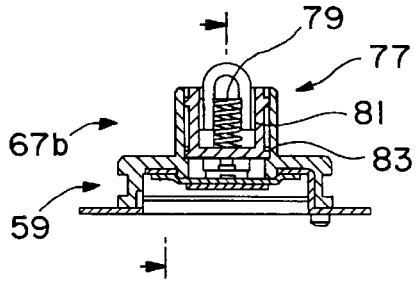
FIG. 12*a* shows a schematic, cross sectional, side elevational view of a second embodiment of a switching system according to the invention.
Figure 12B:
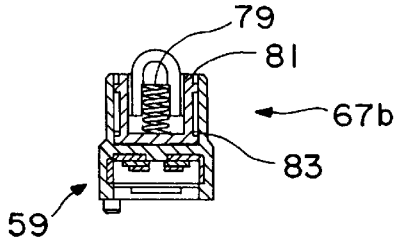
FIG. 12*b* is a sectional view along line A—A of FIG. 12*a;*

FIGS. 12*a* and 12*b* depict an alternative embodiment of a switching system. Here, contrary to the switching system 67*a* of FIG. 9 that includes a sheet-like loading spring, the shown switching system 67*b* has a loading spring that includes a telescoping spring-biased actuator 77. It is noted that this actuator may be incorporated as an element formed as a one-piece unit with the module housing 59, or may be securely connected thereto (not shown). As would be recognized readily by one skilled in the art, the mechanical loading path of the telescoping actuator is advantageously controlled by virtue of the biased (compressed) spring 79 provided therein, and further by virtue of the telescoping cup-shaped loading element 81 whose downward path is limited by lateral stops 83 provided at lower regions thereof. Thus, the actuation path for any actuation mechanism used with this switching system is further buffered by virtue of the structure thereof.

Figure 13A:
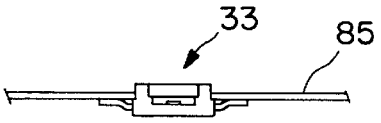
FIGS. 13*a* and 13*b* are schematic, cross sectional side elevational views depicting two respective process steps in forming yet another embodiment of a module housing according to the invention for mounting microswitches in pairs.
Figure 13B:
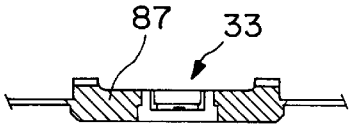
Figure 14A:
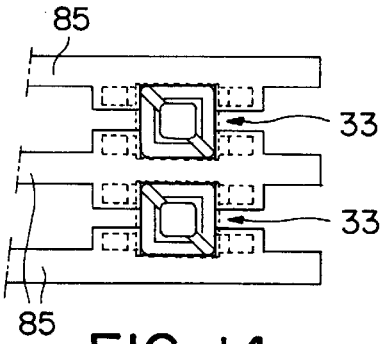
FIGS. 14*a* and 14*b* are top plan views corresponding to FIGS. 13*a* and 13*b*, respectively.
Figure 14B:
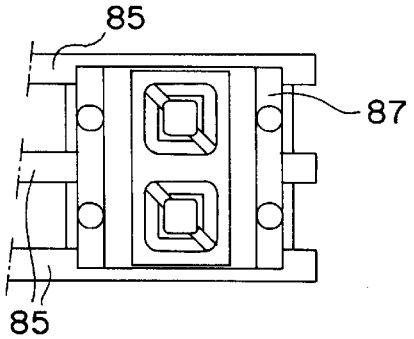
Figure 15:
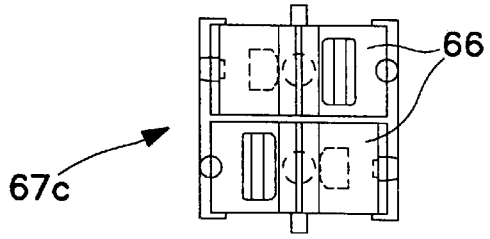
FIG. 15 is a top plan view of a third embodiment of a switching system incorporating a module housing made by following the steps shown in FIGS. 13*a* to 14*b* and further including a pair of loading springs on the module housing.
Figure 16A:
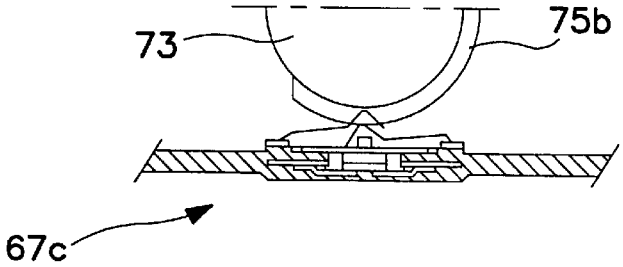
FIGS. 16*a* and 16*b* are views similar to FIGS. 11*a* and 11*b* showing the actuation mechanism depicted in those figures used in conjunction with the switching system of FIG. 15.
Figure 16B:
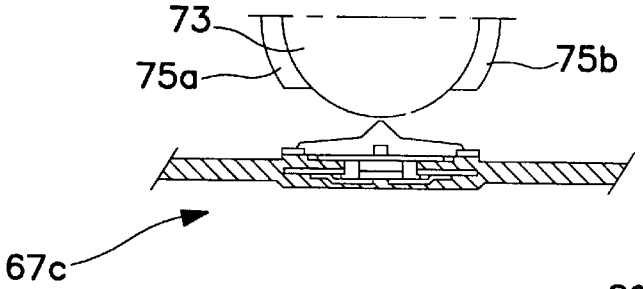

FIGS. 13*a*, 13*b*, 14*a* and 14*b* illustrate two process steps for forming yet another embodiment of a module housing according to the invention for accommodating a pair of microswitch modules. As shown in FIGS. 13*a* and 14*a*, the modules 33 may be soldered onto stamped conductive strips 85, after which a housing material 87 such as a thermoplastic is formed thereon, for example by injection molding, as shown in FIGS. 13*b* and 14*b*. As seen in FIG. 15, the top of the thus formed housings can then be provided with loading springs 66 similar to that shown in FIG. 9. The thus obtained switching system 67*c* including a pair of microswitch modules may thereafter be used in conjunction with an actuating mechanism in the form of a rotatable cam 73 similar to the one shown in FIGS. 11*a* and 11*b*. The cam in this instance may be provided with a pair of offset projections 75*a* and 75*b* which are adapted to actuate corresponding ones of the loading springs, as illustrated in FIG. 16*b*.

Figure 17A:
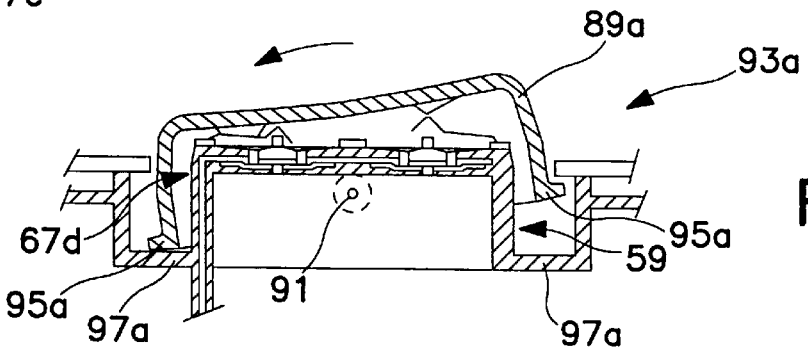
FIGS. 17*a* and 17*b* are cross sectional views of a micromechanical commutative integrated switch incorporating a further embodiment of an actuation mechanism and switching system according to the invention.
Figure 17B:
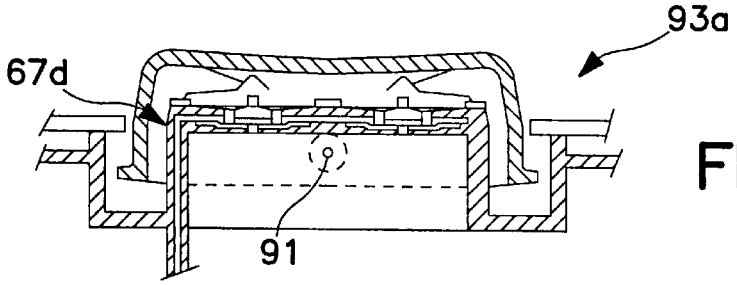

Referring to FIGS. 17*a* and 17*b*, shown is a switching system 67*d* comparable to the one in FIG. 15 but having the pair of modules 33 longitudinally offset from one another. The actuating mechanism in this case comprises a hinged cover 89*a* adapted to rotate by a predetermined angle about its hinge axis 91 for actuating respective ones of the modules in a commutative manner, the assembly forming a micromechanical commutative integrated switch 93*a*. As can be appreciated from FIGS. 17*a* and 17*b*, the angle of rotation of the cover is predetermined by virtue of the presence of one or a plurality of stop members 95*a* abutting against a base region 97*a* of the shown alternate embodiment of the module housing 59.

Figure 18A:
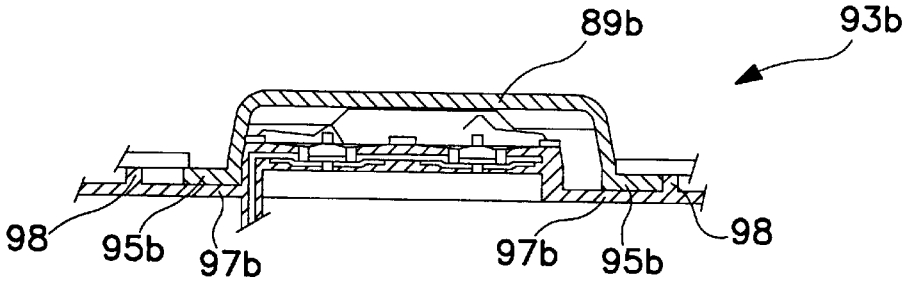
FIGS. 18*a* and 18*b* are views similar to FIGS. 17*a* and 17*b*, respectively, showing a further embodiment of a micromechanical commutative integrated switch according to the invention.
Figure 18B:
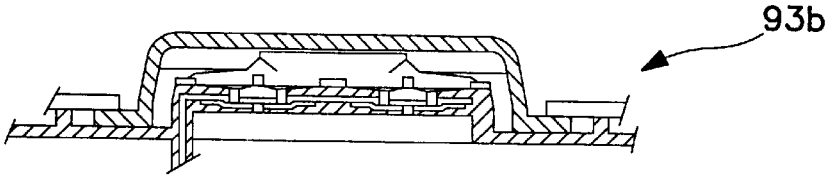

FIGS. 18*a*, 18*b* and 18*c* are views similar to FIGS. 17*a* and 17*b*, respectively, except that, in the shown embodiment of the micromechanical commutative integrated switch 93*b*, the cover 89*b* is adapted to translate by a predetermined distance to actuate respective ones of the modules. Here, as illustrated in FIGS. 18*a* and 18*b*, the translation distance of the cover is predetermined by virtue of the presence of cover stop members 95*b* abutting against stop members 98 of a base region 97*b* of the shown alternate embodiment of the module housing 59.

Figure 19A:
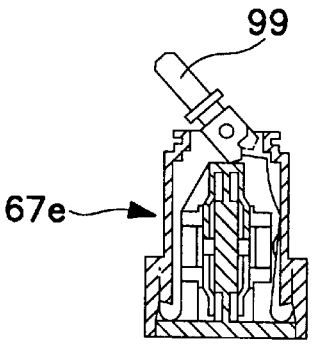
FIGS. 19*a*, 19*b* and 19*c* are cross sectional views of a further embodiment of a micromechanical commutative integrated switch according to the invention.
Figure 19B:
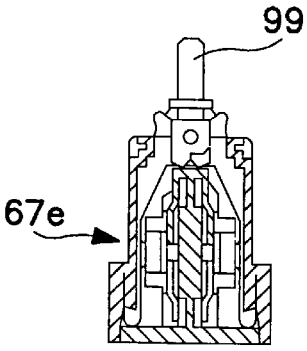
Figure 19C:
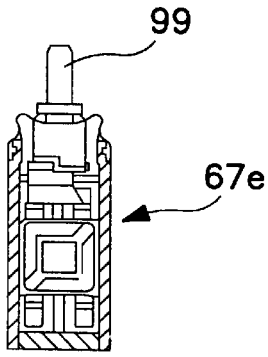

FIGS. 19*a*, 19*b* and 19*c* depict a different embodiment of a micromechanical integrated commutative switch, where the actuating mechanism is a lever 99 rotatable about a hinge for actuating respective ones of a pair of microswitch modules 33. Here, yet another embodiment 67*e* of a switching system is shown having a pair of modules 33.

Figure 20:
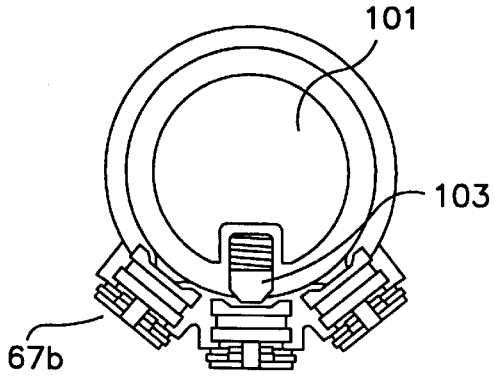
FIGS. 20 and 21 are side elevational views of respective further embodiments of actuation mechanisms used in conjunction with switching systems comparable to that in FIG. 9.
Figure 21:
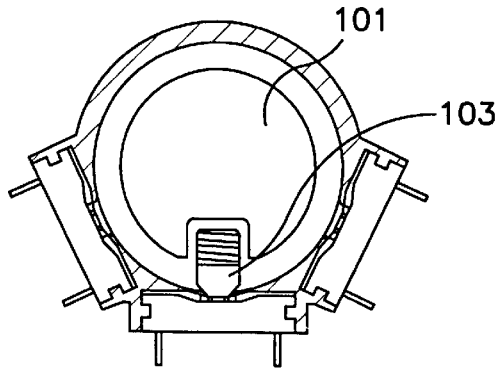
Figure 22:
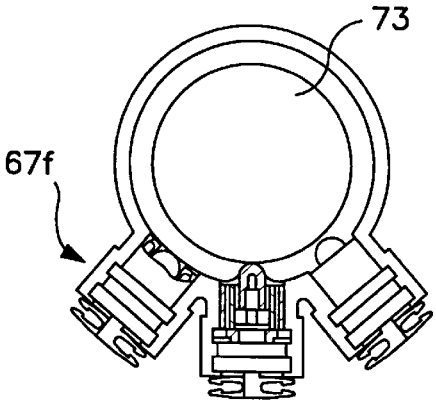
FIGS. 22 and 23 are side elevational views similar to FIGS. 20 and 21 showing further embodiments of actuation systems incorporating switching systems comparable to that in FIGS. 12*a* and 12*b*.
Figure 23:
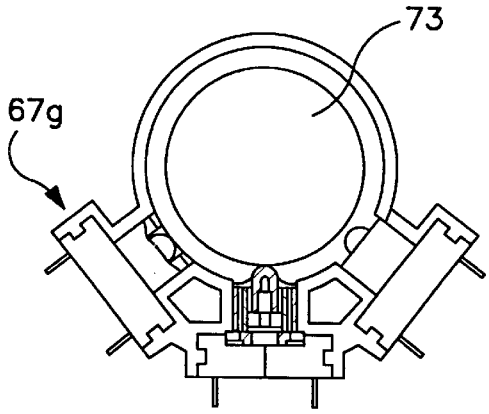

FIGS. 20 and 21 show an actuating mechanism in the form of a rotatable disc 101 incorporating a biased ball therein, used in conjunction with a plurality of module housings and associated modules 58 each comparable to the one shown in FIG. 9. Here, the mechanical loading path is limited by the biasing force of the ball and spring arrangement, while the actuating path of the rotatable disk may be much larger in comparison. FIGS. 22 and 23 show a comparable arrangement, except that the actuating mechanism is a rotatable cam 73 similar to the one in FIGS. 16*a* and 16*b*, and that switching systems 67*f*/67*g* are used comparable to the one shown in FIGS. 12*a* and 12*b*.

It is noted that the above-described combinations of module and module housing systems and/or switching systems one the one hand with actuating mechanisms one the other hand are merely examples according to the invention of the manners in which the module may be integrated into further useful applications, and that other combinations of the shown systems and mechanisms are also intended as being within the scope of the invention. In addition, the embodiments of loading springs and/or actuating mechanisms shown are also merely examples. Thus, any configuration of such loading elements that is within the knowledge of one skilled in the art and that has the function of permitting controlled mechanical loading paths and sufficiently long actuation paths for the loading and actuation of the microswitch module is also intended as being within the scope of the invention.

Moreover, "resin" in the context of the application means a substance in liquid form which, upon exposure to air or to a temperature change, hardens to form a resilient material. It is further noted that this resin, as shown in FIG. 2, can harden to form a sealing and/or adhering bond with the components with which it comes into contact.

Although various minor changes and modifications might be proposed by those skilled in the art, it will be understood that the appended claims are intended to encompass all such changes and modifications which will reasonably fall within the invention's contribution to the field of microswitches.

What is claimed is:

1. A microswitch module comprising:

a microswitch housing defining a cavity therein;

a microswitch being disposed in the cavity of the microswitch;

a layer of resilient material disposed on a loading surface of the microswitch;

an actuator element disposed on the layer of resilient material;

the actuator element and the loading surface of the microswitch being in adherent contact by the layer of resilient material for transmitting a mechanical switching force therethrough to the loading surface of the micro switch for actuating the microswitch; and wherein the layer of resilient material also fills lateral gaps between the actuator element and the cavity and one or more top regions of the actuator element.

2. The module according to any of claim 1, wherein the microswitch is bonded to a cavity surface of the cavity of the microswitch housing.

3. The module according to any of claim 1, wherein a top surface of the actuator element is in registration with a top surface of the microswitch housing.

4. A combination comprising the module according to any of claim 1 and further including a module housing having an outer shell defining a module housing cavity housing the module therein.

5. A switching system including the combination according to claim 4, and further comprising a loading spring secured to the module housing.

6. The switching system according to claim 5, wherein the loading spring is one of a bent resilient sheet having a loading portion thereon and a telescoping spring-biased actuator.

7. A combination comprising the switching system according to any of claim 5 and further including an actuating mechanism disposed adjacent the switching system for applying a mechanical load to the loading spring thereof for actuating the microswitch.

8. The combination according to claim 7, wherein the actuating mechanism comprises one of a rotatable cam, a hinged lever and a cover which is one of translationally and rotationally movable by a predetermined distance.

9. A combination comprising the module according to any of claim 1 and further including:

a module housing having:

an outer shell defining a module housing cavity housing the module therein; and an actuating mechanism disposed adjacent the module for applying a mechanical load thereto for actuating the microswitch.

10. A combination comprising:

a microswitch module which comprises:

a microswitch;

a layer of resilient material disposed on a loading surface of the microswitch; and an actuator element disposed on the layer of resilient material for transmitting a mechanical switching force therethrough to the loading surface of the microswitch for actuating the microswitch; and a module housing having:

an outer shell defining a module housing cavity housing the module therein; and an actuating mechanism disposed adjacent the module for applying a mechanical load thereto for actuating the microswitch;

wherein the actuating mechanism comprises a rotatable disc housing a spring-biased ball therein.

* * * * *